US006260837B1

(12) United States Patent
Nanba et al.

(10) Patent No.: US 6,260,837 B1
(45) Date of Patent: Jul. 17, 2001

(54) SHEET POSTPROCESSING DEVICE

(75) Inventors: Toyoaki Nanba, Higashiosaka; Jinichi Nagata, Osaka; Tomomi Tanaka, Yamatokoriyama; Masahiro Kanezaki, Fukuyama; Mitsuo Matsuda, Hiroshima, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/189,898

(22) Filed: Nov. 11, 1998

(30) Foreign Application Priority Data

Nov. 13, 1997 (JP) ..... 9-312511

(51) Int. Cl.[7] ..... B65H 33/04
(52) U.S. Cl. ..... 270/58.08
(58) Field of Search ..... 270/58.08

(56) References Cited

U.S. PATENT DOCUMENTS

| | | | | |
|---|---|---|---|---|
| 4,822,024 | | 4/1989 | Takahashi | 271/296 |
| 5,131,641 | * | 7/1992 | Hidaka | 270/58.08 |
| 5,320,336 | * | 6/1994 | Asami | 270/58.08 |
| 5,540,421 | * | 7/1996 | Ohta et al. | 270/58.19 |
| 5,590,871 | * | 1/1997 | Okabe et al. | 270/58.27 |
| 5,709,376 | * | 1/1998 | Ushirogata | 270/58.09 |
| 5,765,824 | * | 6/1998 | Kawanao et al. | 270/58.11 |
| 5,772,198 | * | 6/1998 | Yamamoto | 270/58.12 |
| 5,895,036 | * | 4/1999 | Asao | 270/58.09 |
| 5,911,414 | * | 6/1999 | Kato et al. | 270/58.07 |
| 6,082,725 | * | 7/2000 | Shinno et al. | 270/58.14 |

FOREIGN PATENT DOCUMENTS

| | | |
|---|---|---|
| 659667A1 | 12/1994 | (EP) . |
| 745547a2 | 5/1996 | (EP) . |
| 3-192065 | 8/1991 | (JP) . |
| 9015770 | 12/1990 | (WO) . |
| 9513236 | 5/1995 | (WO) . |

* cited by examiner

*Primary Examiner*—Robert P. Olszewski
*Assistant Examiner*—Richard Ridley
(74) *Attorney, Agent, or Firm*—Renner, Otto, Boisselle & Sklar

(57) ABSTRACT

In order to provide a sheet postprocessing device which positively prevents an uneven image from occurring without using any means that spoil the appearance when a set of sheets is ejected onto the ejection tray, and which stacks sets of sheets without disarray, in the present invention, after sheets have been ejected from the copying machine and have been subjected to a stapling operation that is one of post-processing operations, the sheets are ejected onto an offset tray by an ejection roller. The ejecting rollers are provided with a lifting mechanism for lifting the leading portion of the set of stapled sheets with regard to the ejecting direction.

14 Claims, 9 Drawing Sheets

SHEET POSTPROCESSING DEVICE

FIELD OF THE INVENTION

The present invention relates to a sheet postprocessing device which is provided on an image forming apparatus capable of copying, f axing, and printing, and which performs postprocessing operations including stapling on sheets transported from the image forming apparatus before ejection, and particularly concerns a device for stacking sheets on an ejection tray without disarray.

BACKGROUND OF THE INVENTION

In recent years, a copying machine has been combined with an automatic paper feeding device and a sheet postprocessing device so as to realize automatization of copying and postprocessing operations such as stapling and punching on copied sheets. After images have been copied on the sheets and the sheets have been ejected out of the copying machine, the sheet postprocessing device performs postprocessing operations such as stapling and punching for each set of sheets which consists of a predetermined number of sheets.

Here, with regard to the sheet postprocessing device in which, after sheets have been ejected from the copying machine and have been subjected to a stapling operation that is one of post processing operations, the sheets are ejected onto an ejection tray by an ejection roller since, during an ejection, the edge of the set of sheets tends to rub the surface of the set of sheets that has been ejected earlier and stacked onto the ejection tray, the quality of the fixed image on the surface of the stacked sheets may deteriorate.

Further, during the ejection, if the edge of the set of sheets is caught by a staple of the set of sheets which has been ejected and stacked earlier, the sheets are stacked with disarray.

In order to solve the aforementioned problem, for example, Japanese Laid-Open Patent Publication No.192065/1991 (Tokukaihei 3-192065) discloses a conventional sheet postprocessing device.

In the aforementioned sheet postprocessing device, as shown in FIG. 9, a set of stapled sheets 101 is ejected from sheet ejecting rollers 102 and stacked onto an ejection tray 103 which is installed on the inside of the sheet postprocessing device.

The sheet postprocessing device is provided with sheet detecting levers 104 that have two kinds of lengths for detecting the position of leading portions of both large and small sheets which have been stacked on the ejection tray 103, that is, for detecting the highest position of the stacked sheets on the ejection tray 103. A tray ascending/descending device 106 moves the ejection tray 103 downward so that the highest position of sheets is not more than a fixed line 105. With this operation, during the ejection, the sets of sheets ejected out of the sheet ejecting rollers 102 are not supposed to contact with sheets which have been stacked earlier.

In the conventional sheet postprocessing device, since the ejection tray 103 is installed on the inside of the sheet postprocessing device, the sheet detecting levers 104 are not exposed outside; however, in the case when the ejection tray 103 is installed on the outside of the sheet post postprocessing device, the sheet detecting levers 104 are exposed outside. Thus, the problem is that the long sheet detecting levers 104 spoil the appearance.

The present invention is devised in order to solve the aforementioned problem. The objective is to provide a sheet postprocessing device which positively prevents an uneven image from occurring and keeps the sheets aligned during a stacking operation, without using any means which spoil the appearance, when the sets of sheets are ejected from the sheet postprocessing device onto the ejection tray.

SUMMARY OF THE INVENTION

In order to solve the aforementioned problem, the postprocessing device of the present invention, which stacks sheets ejected out of the image forming apparatus onto a postprocessing tray and ejects the sheets through ejecting rollers onto an ejection tray after having carried out a postprocessing operation for binding the stacked sheets, is characterized in that the ejecting rollers are provided with a lifting means for lifting the leading portion of the set of bound sheets with regard to the ejecting direction.

With the aforementioned invention, the sheets which have been ejected out of the image forming apparatus are stacked on the postprocessing tray, and after the postprocessing operation has been performed for binding the sheets, the sheets are normally ejected through the ejecting rollers onto the ejection tray in a state in which the set of sheets are bound at the leading portion thereof with regard to the ejecting direction.

Here, the ejecting rollers are provided with a lifting means for lifting the leading portion of the set of bound sheets with regard to the ejecting direction. Therefore, when the set of sheets is ejected through the ejecting rollers, the lifting means lifts the leading portion so that the set of sheets can be ejected without being in contact with the sets of sheets which have been stacked earlier on the ejection tray.

Thus, during the ejection, the leading portion of the set of sheets does not rub the surface of the set of sheets which has been ejected and stacked earlier onto the ejection tray so that it is possible to prevent degradation in the quality of the image which has been fixed on the surface of the set of sheets.

Further, the lifting means is provided on the ejecting rollers; therefore, the lifting means is not exposed outside even in the case when the ejection tray is installed on the outside of the sheet postprocessing device.

Moreover, in the case when the postprocessing operation is a stapling operation, the leading portion of the set of sheets which is being ejected is not caught by a staple of the set of sheets which has been ejected and stacked earlier onto the ejection tray; therefore, it is possible to stack the sets of sheets without disarray.

Therefore, it is possible to provide a sheet postprocessing device which positively prevents an uneven image from occurring and which prevents the edges of the sheets from being uneven during the stacking operation, without using any means which spoil the appearance, when the set of sheets are ejected out of the sheet postprocessing device onto the ejection tray.

For a fuller understanding of the nature and advantages of the invention, reference should be made to the ensuing detailed description taken in conjunction with the accompanying drawings.

BRIEF DESCRIPTION OF THE DRAWINGS

FIG. 4(*a*) is an explanatory drawing which shows the case in which a sheet fed from a copying machine is transported to a lower staple tray.

FIG. 4(*b*) is an explanatory drawing which shows the case in which a sheet fed from the copying machine is transported to the reverse path.

FIG. 4(*c*) is an explanatory drawing which shows the case in which the sheet transported to the reverse path is sent through a connecting path to a detour path after having been temporarily switched back.

FIG. 4(*d*) is an explanatory drawing which shows the case in which a sheet fed from the copying machine is directly sent to the detour path.

FIG. 5(*a*) is an explanatory drawing which shows a state in which the set of sheets is stacked on the lower staple tray before a stapling operation.

FIG. 5(*b*) is an explanatory drawing which shows a state in which a sheet supporting stand descends so that a stapling operation is performed on the set of sheets.

FIG. 5(*c*) is an explanatory drawing which shows a state in which the set of stapled sheets is moved upward by the sheet supporting stand.

FIG. 5(*d*) is an explanatory drawing which shows a state in which the set of stapled sheets is ejected onto an offset tray.

DESCRIPTION OF THE EMBODIMENTS

[Embodiment 1]

Referring to FIGS. 1 through 8, the following description will explain one embodiment of the present invention.

Figure 2:
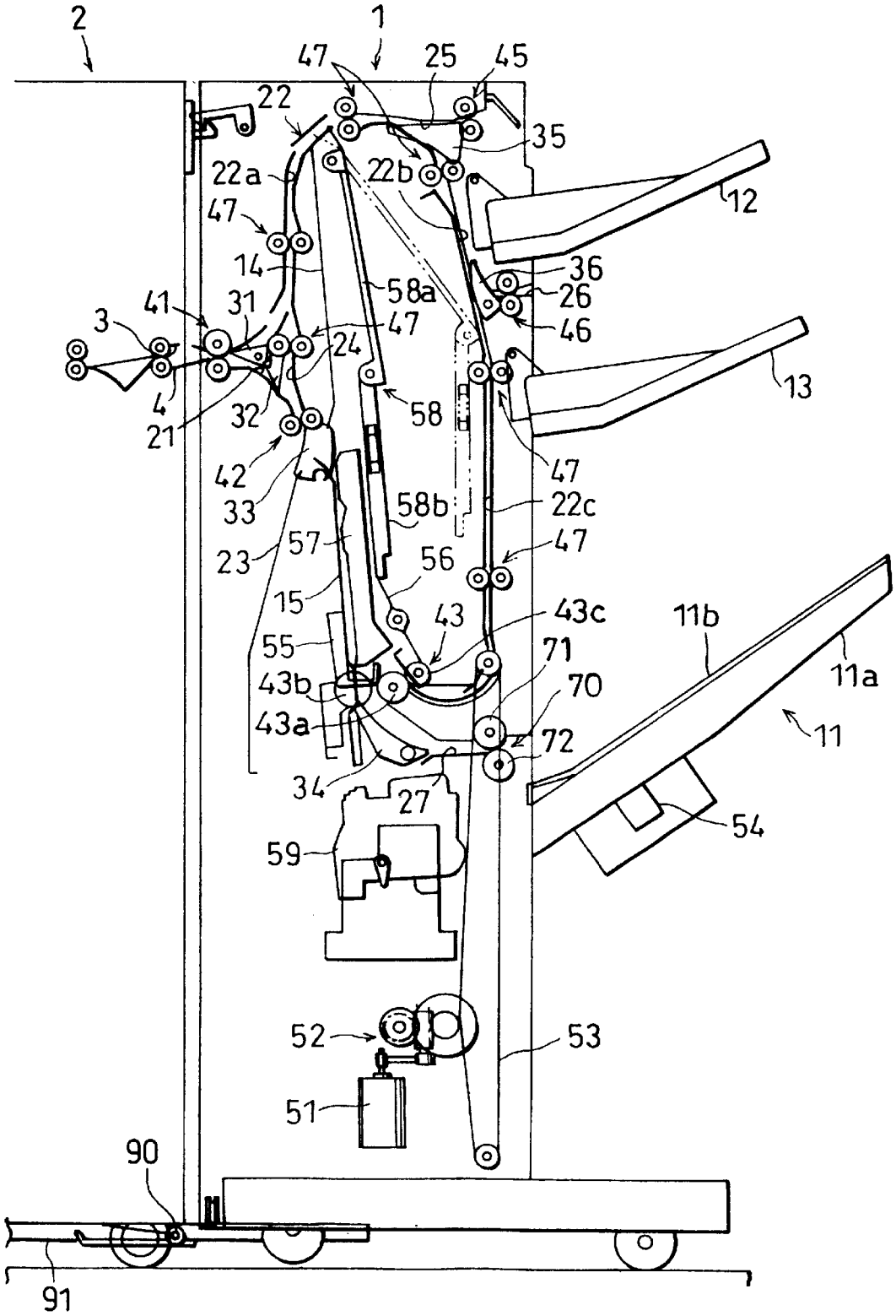
FIG. 2 is an entire construction drawing which shows schematically the sheet postprocessing device.

As shown in FIG. 2, a sheet postprocessing device 1 of the present invention is installed on the side of a sheet ejecting outlet 3 of a copying machine 2 serving as an image forming apparatus such as a digital copying machine, a digital color copying machine, and other commercial copying machines. The sheet postprocessing device 1 is provided for carrying out postprocessing operations such as stapling and others and a sorting operation on sheets including ejected sheets out of the copying machine 2 and OHP sheets.

Additionally, among post-process operations which are conducted by the sheet postprocessing device 1 for sheets, there are punching and pasting besides stapling; however, this embodiment takes a case when a stapling is carried out as a postprocessing as an example of the present invention.

Moreover, the sheet postprocessing device 1 is separably attached to the copying machine 2 in the direction of ejecting sheets when the copying machine 2 or the sheet postprocessing device 1 has a paper jam, or when staples are replenished. When the sheet postprocessing device 1 is connected with the copying machine 2, as shown in FIG. 2, a slanted rail 91 is set on a guide member 90 on the side of the copying machine 2. Therefore, it is possible to make two heights the same precisely: the height of the sheet ejection outlet 3 of the copying machine 2 and the height of a sheet feeding inlet 4 of the sheet postprocessing device 1.

Further, the sheet postprocessing device 1 is provided with, for example, an offset tray 11 as an ejection tray on which a large number of copied sheets are placed after having been stapled. The offset tray 11 is capable of performing ascending/descending operations and an offset sorting operation which is mentioned below.

The driving force of a ascending/descending motor 51 is transmitted through a driving force transmission system 52 composed of a gear and others and a driving wire 53 so that the offset tray 11 ascends and descends.

Moreover, the offset tray 11 has a double structure which consists of a lower offset tray reinforcing plate 11*a* and an upper offset tray plate 11*b*. The offset tray plate 11*b* can move horizontally in a direction vertical to the sheet-transporting direction by the driving force of an offset motor 54, on the offset tray reinforcing plate 11*a*. With this operation, in the case when a plurality of sheets or a plurality of sets of sheets are ejected and offset sorting is performed, the offset tray plate 11*b* is shifted to the right and left alternately for each ejection so that ejected sheets are stacked in a manner where sets of sheets are sorted to the right and left alternately. Therefore, especially in a case when a stapling operation is not performed on the set of sheets, it becomes quite easy to sort sheets.

Further, besides the offset tray 11, the sheet postprocessing device 1 is provided with two types of fixed tray; an upper fixed tray 12 and a lower fixed tray 13. Namely, besides a copy mode, operation modes such as a fax mode and printer mode are available in the copying machine 2 of the present embodiment. For example, the upper fixed tray 12 is set as an ejection tray during a fax mode, and the lower fixed tray 13 is set as an ejection tray during a printer mode.

The sheet postprocessing device 1 is internally provided with a plurality of paths which are combined in various ways in accordance with a size of ejected sheets, whether stapling is performed or not, whether a reversed ejection is necessary or not, and a type of an ejection tray. With this arrangement, one transportation process is made by combining desired paths among the plurality of paths, necessary operations are carried out on sheets, and then the sheets are ejected.

The plurality of paths are, specifically, composed of a direct path 21, a detour path 22, a reverse path 23, a connecting path 24, an upper fixed tray ejection path 25, a lower fixed tray ejection path 26, an offset tray ejection path 27, and a lower staple tray 15.

The direct path 21 extends downward from the sheet feeding inlet 4 and, via a reverse roller 42, is connected to a gap portion (shown in FIG. 4(*a*)) which is provided between an upper staple tray 14 and the lower staple tray 15 which are installed vertically as mentioned below. Therefore, a sheet ejected from the copying machine 2 is transported through the direct path 21 and the reverse roller 42 to the lower staple tray 15.

The detour path 22 extends upward from the sheet feeding inlet 4, detours while curving above the upper portion of the upper staple tray 14, extends downward in the vicinity of the side of trays of the sheet postprocessing device 1 after detouring, detours again just before reaching the position on which the offset tray 11 is installed, and then the detour path 22 is connected to the lower portion of the lower staple tray 15. Further, the detour path 22 extends from the sheet feeding inlet 4 to the lower portion of the lower staple tray 15 and is divided into three parts; the detour paths 22*a*, 22*b*, and 22*c*. Additionally, the upper fixed tray ejection path 25 branches out from the contact portion between the detour paths 22*a* and 22*b*. The upper fixed tray ejection path 25 serves as a path for ejecting sheets to the upper fixed tray 12. On the other hand, the lower fixed tray ejection path 26 branches out from the contact portion between the detour paths 22*b* and 22*c*. The upper fixed tray ejection path 26 serves as a path for ejecting sheets onto the lower fixed tray 13.

In the vicinity of the reverse roller 42 installed at the lower portion of the direct path 21, the reverse path 23 extends almost vertically closer to the copying machine 2 starting from the vicinity of the contact portion with a gap portion between the upper staple tray 14 and the lower staple tray 15. In other words, in addition to a case when a sheet transported from the direct path 21 is transported to the lower staple tray 15, a sheet may be transported to the reverse path 23. And then, the sheet introduced to the reverse path 23 is transported from the connecting path 24 to the detour path 22 by reversed rotation of the reverse roller 42. Therefore, the reverse path 23 and connecting path 24 are used when a sheet is sent to the detour path 22 by switching temporarily back the sheet.

The offset tray ejection path 27 extends downward from the lowest portion of the lower staple tray 15 and passes below the detour path 22. A sheet sent from the lowest potion of the lower staple tray 15 is ejected from the offset tray ejection path 27 onto the offset tray 11.

Namely, the switching of each transporting path is performed by switching gates provided on junctions of paths and switching the directions of rotation of a transporting roller. The detail of these switching operations will be described below.

The lower staple tray 15 is arranged as a part of a staple tray which serves as a postprocessing tray extending vertically for storing sets of stacked sheets temporarily before stapling. In the present embodiment, the lower staple tray 15 is used as a path which constitutes a part of a transporting path.

Namely, in the present embodiment, the staple tray is positioned almost vertically in the vicinity of the upper part of the sheet postprocessing device 1 in a state in which the staple tray is divided into the upper staple tray 14 and the lower staple tray 15. And a gap is provided between the upper staple tray 14 and the lower staple tray 15; therefore, as mentioned above, it is possible to transport a sheet from the direct path 21 to the lower staple tray 15 through the gap.

In the case when sheets are stapled in the sheet postprocessing device 1, sheets are stacked on the staple tray. When sheets are stacked on the staple tray, a rear portion of a sheet is placed on a sheet supporting stand 55 and the lower edge of sheets is adjusted by the sheet supporting stand 55. However, the sheets transported to the staple tray may not be adjusted sufficiently on the sheet supporting stand 55 due to static electricity and others. To prevent this problem, for each transport of a sheet, a rotation of a paddler 56 (counterclockwise in FIG. 2) transports a sheet downward so that the sheet is adjusted positively. The paddler 56 transports the sheet by use of a flexible wing portion which is made of an elastic material such as rubber. Further, the paddler 56 rotates once every time one sheet is transported to the staple tray.

Moreover, an adjusting plate 57 holds the sides of a set of sheets so that the side edges of sheets stacked on the sheet supporting stand 55 are properly adjusted. Further, as mentioned above, the staple tray extends upward and downward and the upper staple tray 14 supports only one surface of stacked sheets; therefore, the sheets may fall down to the opposite side of the staple tray.

To prevent the aforementioned problem, a paper guide section 58 is provided at least on the vicinity of the leading portion of the stacked sheets so that sheets are sandwiched and held between the staple tray and the paper guide section 58. The paper guide section 58 is, for example, constituted by two connecting plates 58*a* and 58*b*. When dealing with paper jam, it is possible to move the paper guide section 58 manually to a shelter position.

A stapler 59 is installed below the staple tray. When a predetermined number of sheets are stacked on the sheet supporting stand 55, the sheet supporting stand 55 descends to a position in which stapling is performed by the stapler 59, while holding the set of sheets. After the stapler 59 has stapled the set of sheets, the sheet supporting stand 55 ascends while holding sheets so that the set of sheets returns to the position of the staple tray. Successively, the sheet supporting stand 55 descends so that the set of sheets is ejected onto the offset tray 11 through the offset tray ejection path 27.

With the aforementioned arrangement, the sheet postprocessing device 1 controls the operations of gates and transporting rollers and switches transporting processes in accordance with an operation mode of the copying machine 2 and size of transported sheets. The following explanation describes operations of the sheet postprocessing device 1 at each operation mode of the copying machine 2.

(Copy Mode Operation)

In the case when, during a copy mode of the copying machine 2, stapling is carried out for each set consisting of a predetermined number of sheets ejected out of the copying machine 2, a transporting process in the sheet postprocessing device 1 differs depending upon whether the sheet size is larger than letter size (A4 sideways) or not.

Firstly, the following explains a case when the sheet size is not larger than letter size. Incidentally, in this case, in FIG. 3, the order of transporting process is: the direct path 21 the staple tray (only the lower staple tray 15)→the offset tray ejection path 27→the offset tray 11.

As shown in FIG. 2, a sheet ejected out of the sheet ejecting outlet 3 of the copying machine 2 is fed through the sheet feeding inlet 4 of the sheet postprocessing device 1 and a paper feeding roller 41 transports the sheet to the direct path 21 installed inside of the sheet postprocessing device 1. And then, the reverse roller 42 transports the sheet from the direct path 21 to the lower staple tray 15. Additionally, the reverse roller 42 is capable of freely switching the rotations between the forward and backward rotations. The forward rotation of the reverse roller 42 transports the sheet from the direct path 21 to the lower staple tray 15 or to the reverse path 23. Further, when the reverse roller 42 rotates in the backward direction, the sheet is transported from the direct path 21 through the connecting path 24 to the detour path 22.

Here, in the vicinity of the paper feeding roller 41 and the reverse roller 42, at the start of the downstream side of the paper feeding roller 41, a paper feeding gate 31 is provided for switching the transporting paths of a sheet that has been fed between the direct path 21 and the detour path 22. A reverse gate 32 is provided on the upstream side of the reverse roller 42 for switching the directions of rotation in accordance with a change between the forward and backward rotations of the reverse roller 42. Further, at the start of the downstream side of the reverse roller 42, a switching gate 33 is provided for switching the transporting paths of a sheet between the lower staple tray 15 and the reverse path 23 during the forward rotation of the reverse roller 42.

Namely, during the copy mode of the copying machine 2, in a case when sheets which are not larger than letter size are stapled, the paper feeding gate 31, the reverse gate 32, and the switching gate 33 are switched to the positions as shown in FIG. 4(*a*).

Figure 5:
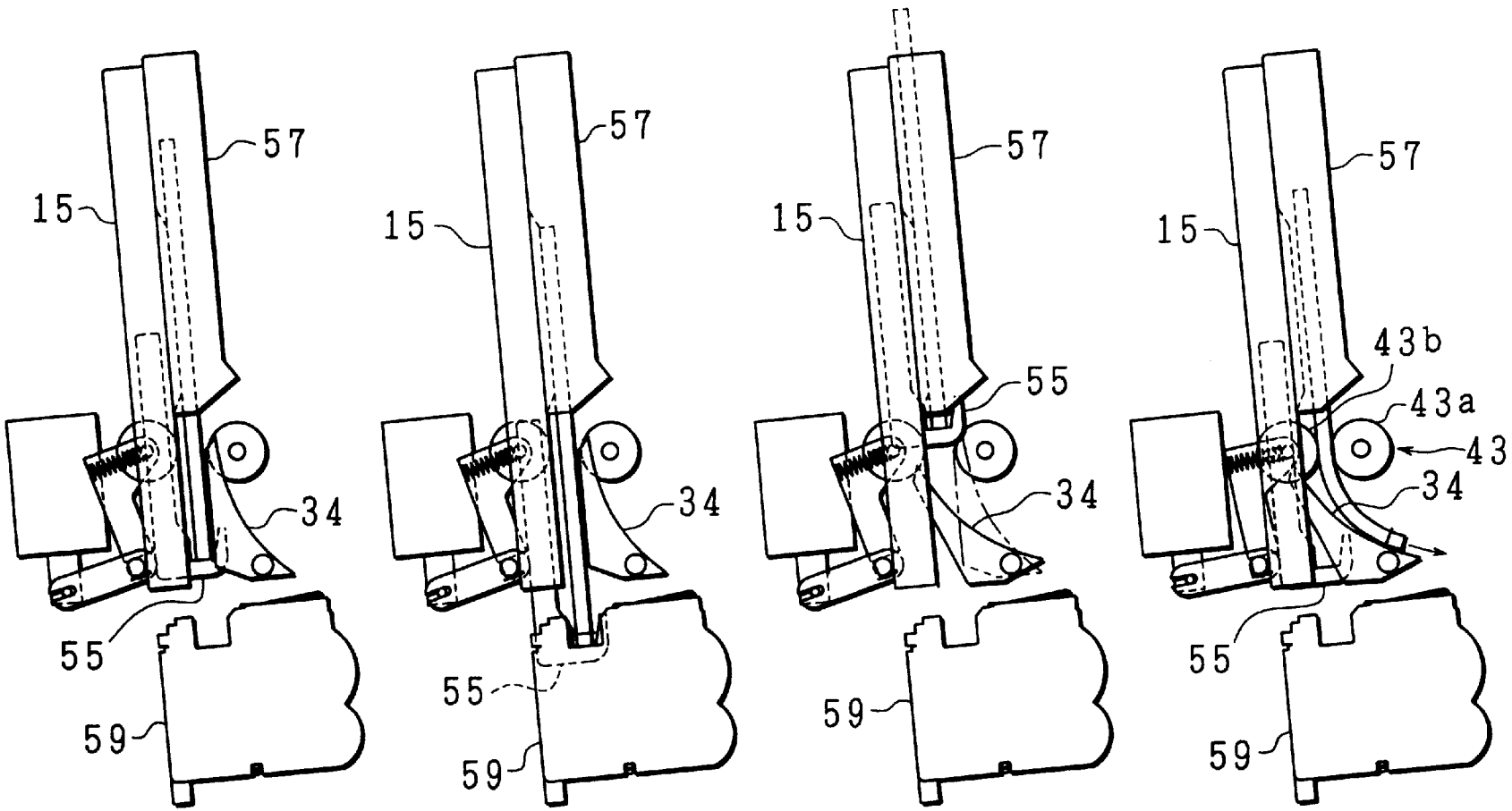
FIGS. 5(*a*) through 5(*d*) show operations when a stapling operation is performed on a set of sheets.

The sheet transported through the direct path 21 is sent to a gap between the upper staple tray 14 and the lower staple tray 15 by being guided by the switching gate 33. As shown in FIG. 5(*a*), the sheet is sent through the upper portion of the lower staple tray 15 and stacked onto the lower staple tray 15. In this case, the sheet size is smaller than letter size; therefore, the sheets are not placed out of the lower staple tray 15.

When a predetermined number of sheets is stacked on the sheet supporting stand 55, the sheet supporting stand 55 descends so that the set of sheets is shifted to the stapler 59 and stapled as shown in FIG. 5(*b*). Incidentally, at this time, a switching gate 34, which is provided on the downstream side of the lower staple tray 15 for switching the transporting directions of the set of sheets to the offset tray 11 or the stapler 59, is switched to a position for sending the set of sheets to the stapler 59.

When stapling of the stapler 59 is completed, the sheet supporting stand 55 ascends, and as shown in FIG. 5(*c*), the set of sheets ascends back to the position higher than the switching gate 34. Afterwards, the switching gate 34 is switched to the position for ejecting sheets to the offset tray 11. With this condition, as shown in FIG. 5(*d*), the sheet supporting stand 55 descends and the transporting roller 43, provided on the upstream side of the switching gate 34, rotates sheets while pressing so that the set of sheets is sent to the offset tray ejection path 27. Successively, an ejecting roller section 70 acting as ejecting rollers ejects the set of sheets through the offset tray ejection path 27 to the offset tray 11.

Namely, the transporting roller 43 is constituted by a driving roller 43*a* and the two driven rollers 43*b* and 43*c*. When the set of sheets is sent to the offset tray ejection path 27, the driving roller 43*a* and the driven roller 43*b* are used. On the other hand, the driven roller 43*c* and the driving roller 43*a* are used simultaneously when sheets transported from the detour path 22 are sent to the staple tray. Further, the driven roller 43*b* is separably attached to the driving roller 43*a*. When a set of sheets is sent to the stapler 59, the driven roller 43*b* shifts to a shelter position so that it is possible to prevent the driven roller 43*b* from interfering the shifting of sheets.

Figure 3:
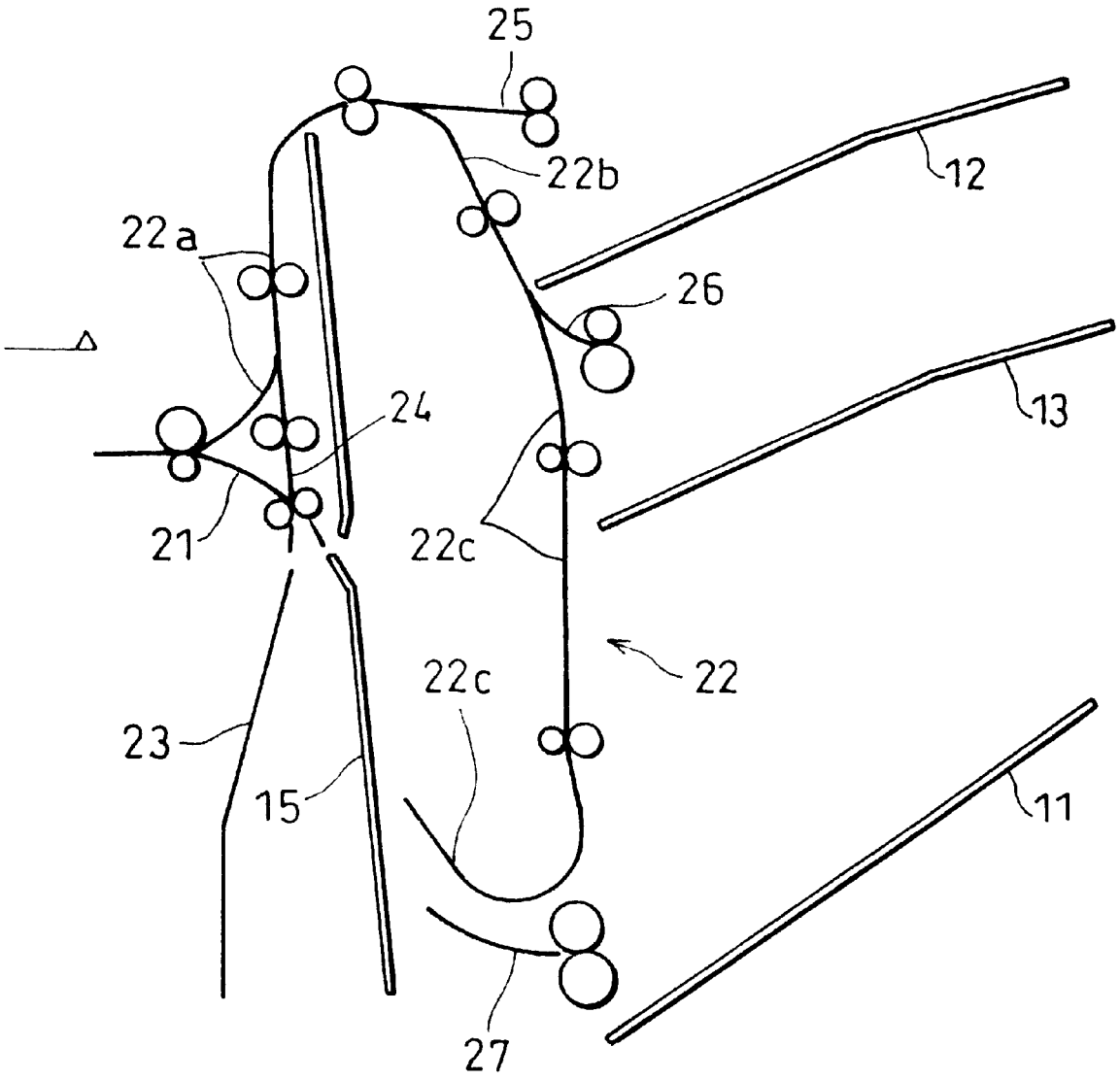
FIG. 3 is an explanatory drawing which shows an arrangement of paths of the sheet postprocessing device.
Figure 4A:
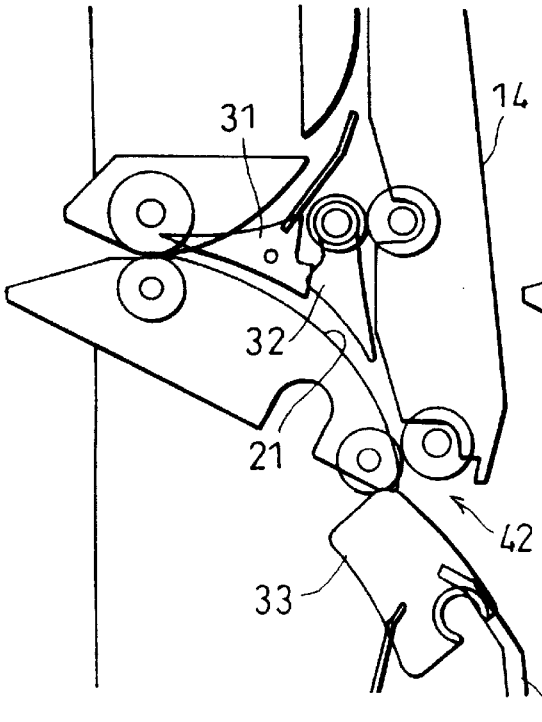
FIGS. 4(*a*) through 4(*d*) show switching conditions of a paper feeding gate, a reverse gate, and a switching gate of the sheet postprocessing device.
Figure 4B:
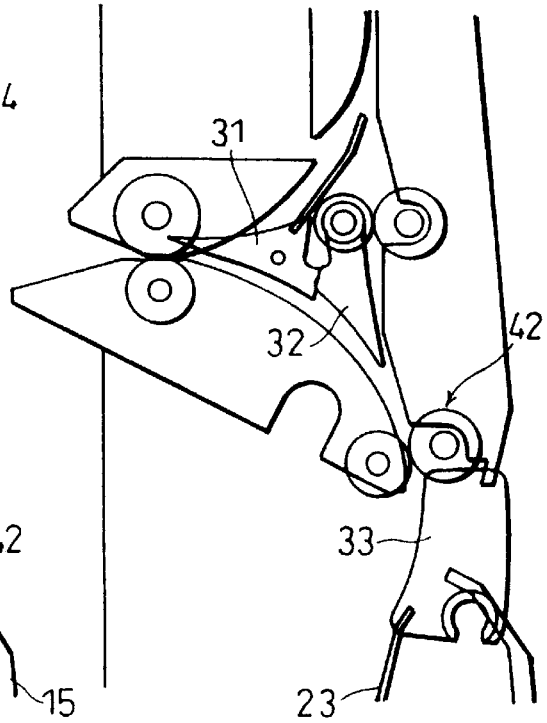
Figure 4C:
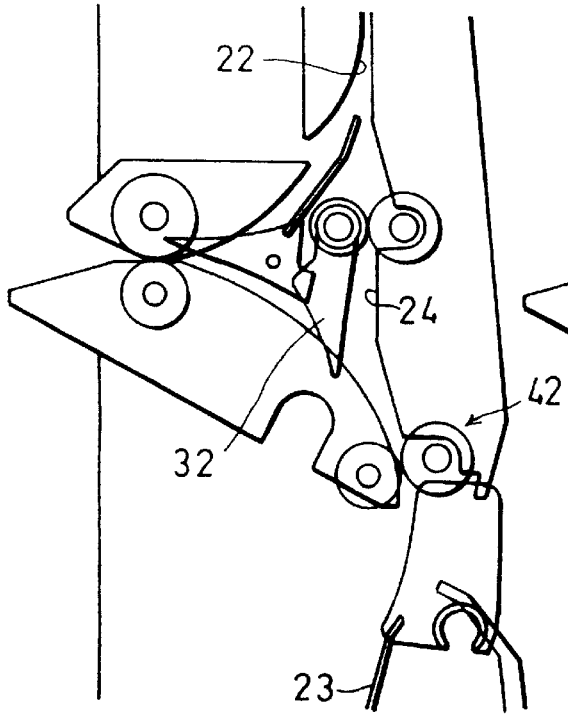
Figure 4D:
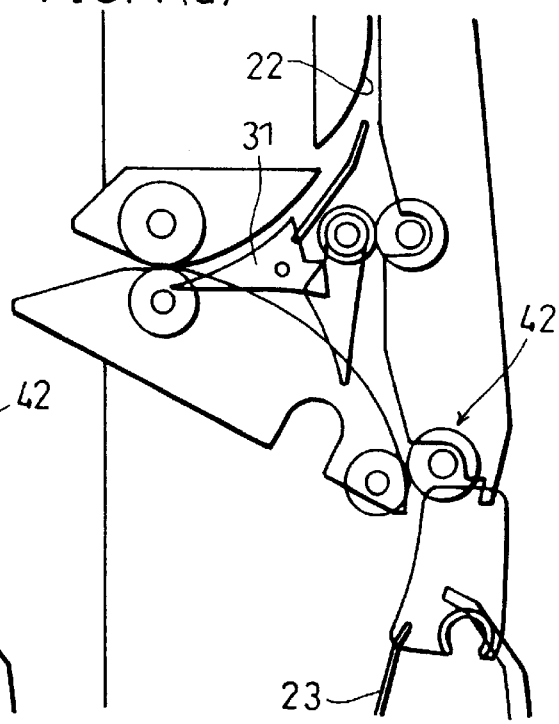

The following explanation discusses the case when a sheet size is larger than letter size. Incidentally, in this case, as shown in FIG. 3, the order of transporting process is: the direct path 21→the reverse path 23→the connecting path 24→the detour path 22→the staple tray (including the upper staple tray 14 and the lower staple tray 15)→the offset tray ejection path 27→the offset tray 11.

As shown in FIG. 2, a sheet fed from the copying machine 2 is firstly sent to the direct path 21 and then to the reverse path 23. At this time, the paper feeding gate 31, the reverse gate 32, and the switching gate 33 are switched to the positions as shown in FIG. 4(*b*).

With this arrangement, when a sheet is sent to the reverse path 23 and the end edge passes through the reverse gate 32, as shown in FIG. 4(*c*), the reverse gate 32 is switched to the position for sending a sheet from the reverse path 23 to the detour path 22, and the rotating direction of the reverse roller 42 is switched to the opposite. Therefore, a sheet fed from the copying machine 2 is temporarily switched back at the reverse path 23 and then sent through the connecting path 24 to the detour path 22.

Furthermore, in the present embodiment, the rear end of a sheet being ejected from the copying machine 2 is defined as the rear portion of a sheet. In the same manner, the leading end of a sheet being ejected from the copying machine 2 is defined as the leading portion of a sheet. Therefore, a sheet which is switched back at the reverse path 23 is transported to the detour path 22 in a state in which the rear portion of the sheet travels ahead.

The following is the reason why a sheet is switched back at the reverse path 23 before having been transported to the detour path 22. In other words, in the case when the copying machine 2 is in a copy mode, the copying machine 2 ejects sheets from the last page. Therefore, when sheets are stapled, it is necessary to stack sheets with their face up on the staple tray, that is, to stack sheets with their image-bearing surface always facing up in succession. However, in the sheet postprocessing device 1 of the present invention, if the sheets ejected from the copying machine 2 are stacked on the staple tray directly through the detour path 22, the sheets are stacked with their face down. Therefore, in the sheet postprocessing device 1, a sheet is temporarily switched back at the reverse path 23 before being transported to the detour path 22 so as to be stacked on the staple tray with their face up.

A sheet, which has been transported to the detour path 22, passes through the whole course of the detour path 22 by transporting rollers 47 which are provided in the detour path 22 with proper intervals, and is sent to the staple tray from the lowest portion of the staple tray 15 by the transporting rollers 43. Here, the driving roller 43*a* and the driven roller 43*c* are used as the transporting rollers 43. At this time, since the sheet size is larger than letter size, the sheet is stacked in a state in which both the upper staple tray 14 and the lower staple tray 15 support the sheets.

Namely, in the case when the sheet size exceeds letter size, if the sheet is sent to the staple tray by means of the direct path 21, the sheet is placed out of the lower staple tray 15 since the sheet size is too large. Consequently, a transport jam occurs in the direct path 21; therefore, in this case, the detour path 22 is used for sending a sheet to the staple tray.

Since the process after sheets have been stacked on the staple tray is same as a case when the sheet size is smaller than letter size, the explanation thereof is omitted.

Further, during a copy mode without using the stapling process, regardless of sheet size, the order of transporting process is: the direct path 21 the staple tray (only the lower staple tray 15)→the offset tray ejection path 27→the offset tray 11, in FIG. 3.

Namely, in this case, a sheet transported from the copying machine 2 does not have to be stacked on the lower staple tray 15, and sheets are ejected onto the offset tray 11 one by one. Therefore, at this time, the sheet supporting stand 55 keeps a low position, and the switching gate 34 keeps a position for ejecting sheets onto the offset tray 11.

(Fax Mode and Printer Mode Operations)

As described above, sheets, which are to be ejected from the copying machine 2, are ejected onto the upper fixed tray 12 during a fax mode and are ejected onto the lower fixed tray 13 during a printer mode. Note that, sheets are normally ejected with their face up from the last page during a copy mode, while sheets are ejected from the first page during the fax mode and the printer mode.

For this reason, if sheets are ejected with their face up in the same manner as the copy mode, the sheets are placed in the opposite order after ejection. Therefore, in the fax mode and the printer mode, sheets are switched back before having been ejected onto a tray so as to be placed with their face down.

That is, in FIG. 3, the order of the transporting process during the fax mode is: the direct path 21 the reverse path 23→the connecting path 24→the detour path 22*a*→the upper fixed tray ejection path 25→the upper fixed tray 12. On the other hand, in FIG. 3, the transporting process during the printer mode is: the direct path 21→the reverse path 23→the connecting path 24→the detour path 22*a*→the detour path 22*b*→the lower fixed tray ejection path 26→the lower fixed tray 13.

With this arrangement, during the fax mode and the printer mode, a sheet which has been fed from the copying machine 2 is sent to the reverse path 23 once, and after having been switched back, the sheet is sent to the detour path 22. The operation of the sheet postprocessing device 1 at this time is the same as the case when sheets larger than letter size are stapled during the copy mode.

With this arrangement, as shown in FIG. 2, the sheet sent to the detour path 22 is ejected to the upper fixed tray 12 or the lower fixed tray 13 en route during the process of the detour path 22. Namely, during the fax mode, by switching paper ejecting gate 35, a sheet transported through the detour path 22 is ejected through the upper fixed tray ejection path 25 to the upper fixed tray 12 by means of paper ejecting roller 45. During the printer mode, by switching paper ejecting gate 36, a sheet is ejected through the lower fixed tray ejection path 26 to the lower fixed tray 13 by means of paper ejecting roller 46.

Additionally, in the case when the copying machine 2 is provided with a large capacity of memory so that it is possible to store all image data in the memory and to print and eject from the last page, it is not necessary to switch back a sheet. Therefore, it is possible to send a sheet fed from the copying machine 2 through the sheet feeding inlet 4 directly to the detour path 22 without using the reverse path 23, and then to eject the sheet to the upper fixed tray 12 or the lower fixed tray 13. In this case, the paper feeding gate 31 is switched to the position as shown in the FIG. 4(*d*).

Moreover, in the case when stapling is performed during the fax mode or the printer mode, the transporting process of the sheet postprocessing device 1 differs depending upon whether the copying machine 2 is provided with enough memory or not.

In the case when the copying machine 2 is provided with enough memory, it is possible to print and eject sheets from the last page in the same manner as the copy mode. Therefore, the transporting process of the sheet postprocessing device 1 is the same as that of the copy mode. Namely, when a sheet is not larger than letter size, the order of the transporting process is: the direct path 21→the staple tray (only the lower staple tray 15) the offset tray ejection path 27→the offset tray 11. When a sheet is not smaller than letter size, the order of the transporting process is: the direct path 21→the reverse path 23→the connecting path 24→the detour path 22→the staple tray (including the upper staple tray 14 and the lower staple tray 15)→the offset tray ejection path 27→the offset tray 11. Further, switching operations for each roller and gate are the same as the copy mode.

On the other hand, in the case when the copying machine 2 is not provided with enough memory, sheets are printed and ejected from the first page. Therefore, it is necessary to stack sheets with their face down on the staple tray. At this time, if the direct path 21 is used for sending sheets directly to the lower staple tray 15, it is not possible to stack sheets with their face down. In this case, regardless of sheet size, the detour path 22 is used for transporting the sheets to the staple tray.

Namely, in FIG. 3, the order of the transporting process is: the detour path 22→the staple tray (only the lower staple tray 15, or including the upper staple tray 14 and the lower staple tray 15)→the offset tray ejection path 27→the offset tray 11.

However, image data may exceed the capacity of memory of the copying machine 2. In this case, the copying machine 2 ejects sheets from the first page; therefore, lower rollers 72 perform the same operation even in the case when the copying machine 2 is not provided with enough memory.

The above description explained the transporting course in accordance with operation modes of the copying machine 2 for the sheet postprocessing device 1 of the present embodiment.

Here, the sheet postprocessing device 1 of the present invention is further characterized as follows:

As shown in FIG. 2, in the sheet postprocessing device 1 of the present embodiment, an ejecting roller section 70 is constituted by upper rollers 71 and the lower rollers 72 so as to eject sets of sheets onto the offset tray 11. Each roller has the same external diameter and is capable of rotating independently. Moreover, the ejecting roller section 70 corresponds to an ejecting roller which is defined in claims.

Figure 6:
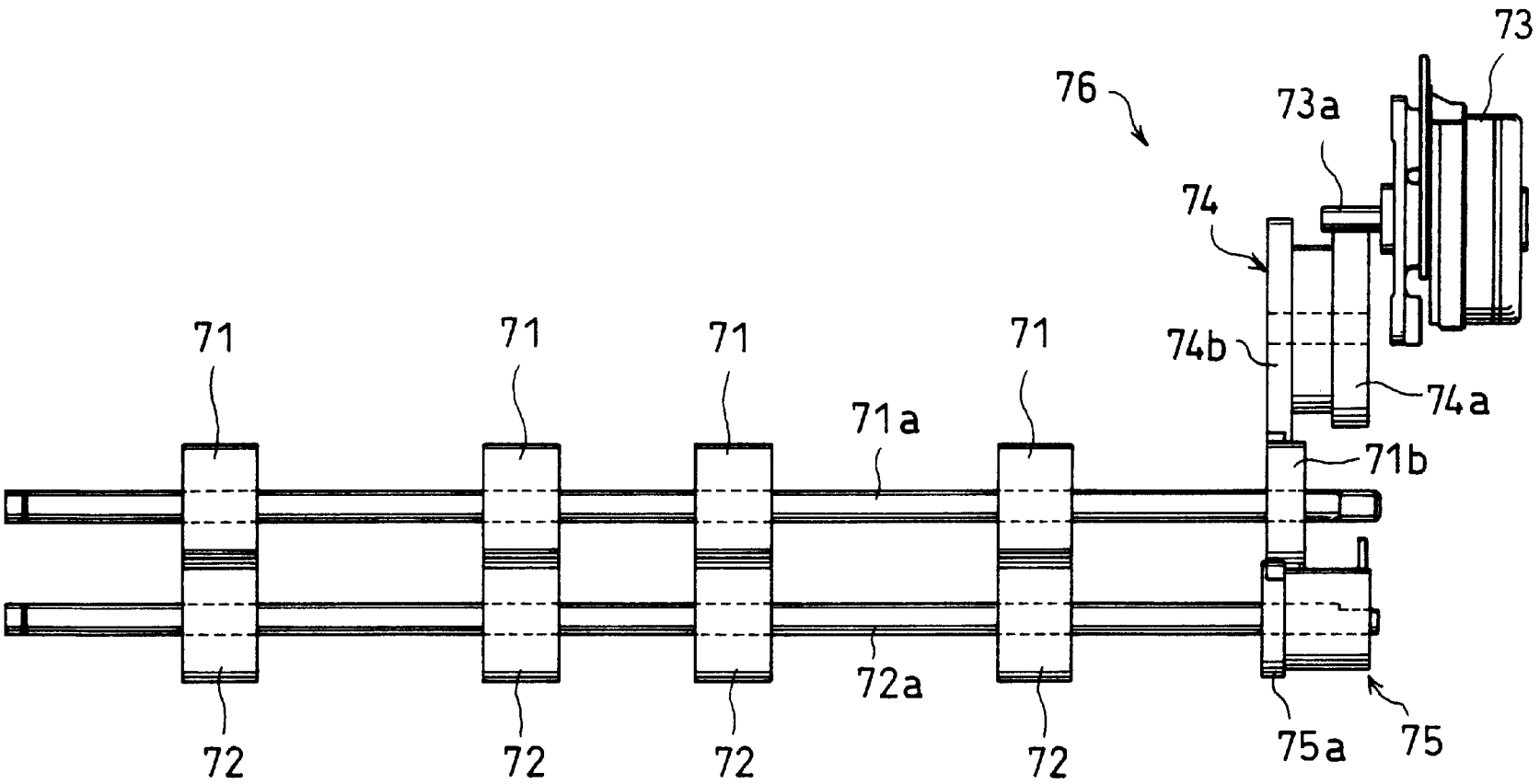
FIG. 6 is a front view which shows the construction of a lifting mechanism of the sheet postprocessing device.
Figure 7:
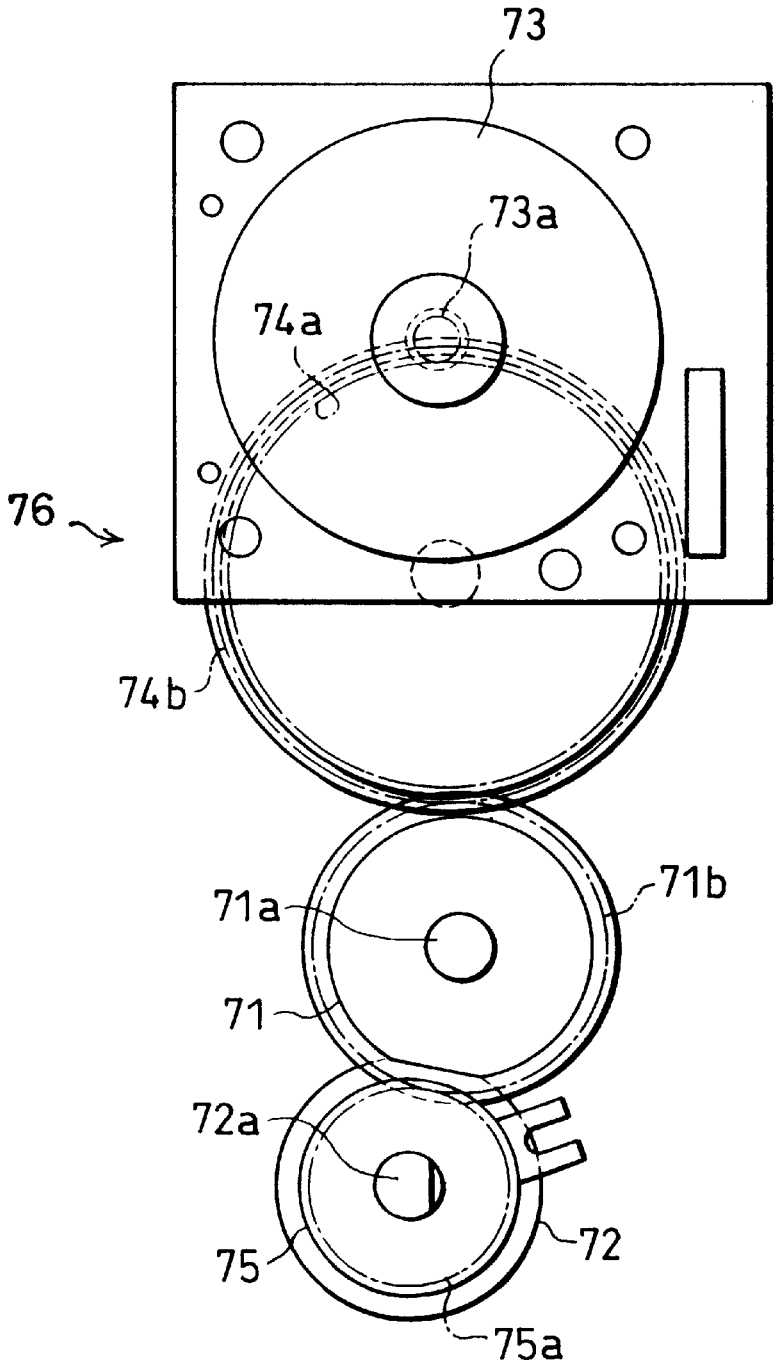
FIG. 7 is a side view which shows the construction of the lifting mechanism of the sheet postprocessing device.

As shown in FIGS. 6 and 7, the upper rollers 71 and the lower rollers 72 are installed respectively on roller axes 71*a* and 72*a* (rotating axis) which extend horizontally. Along the axes, four pairs of rollers are installed in a manner in which the upper rollers 71 and the lower rollers 72 are pressed to each other. On the right end of the axis, a transporting motor 73 is installed for driving the upper rollers 71 and the lower rollers 72.

A motor axis 73*a* of the transporting motor 73 is provided with a pressing roller 74*a* of driving force connecting section 74 in a pressed state, and on the same axis where the pressing roller 74*a* is installed, a driving gear 74*b* is provided.

Further, the driving gear 74*b* is engaged with an upper roller gear 71*b* which is fixed on the roller axis 71*a* for driving the upper rollers 71.

Moreover, the upper roller gear 71*b* is engaged with a lower roller gear 75*a* which is fixed on a clutch 75 acting as a switching means. The clutch 75, which is provided with the lower roller gear 75*a*, is capable of internally disengaging and engaging the roller axis 72*a*. Further, the clutch 75 is provided with a holding mechanism (not shown) for holding the roller axis 72*a*. This holding mechanism makes it possible to cut off and transmit rotation driving force to the roller axis 72*a*.

Therefore, when the clutch 75 does not hold the roller axis 72*a*, the driving force of the lower roller gear 75*a* that is engaged with the upper roller gear 71*b* is not transmitted to the roller axis 72*a*; therefore, the clutch 75 and the lower roller gear 75*a* are driven integrally by the driving gear 74*b*. Consequently, the lower rollers 72 are allowed to rotate together with the upper rollers 71 due to friction with the upper rollers 71.

When the clutch 75 holds the roller axis 72*a*, the driving force of the upper roller gear 71*b* is transmitted to the roller axis 72*a* via the lower roller gear 75*a* and the clutch 75. Therefore, both of the lower rollers 72 and the upper rollers 71 rotate with the driving force.

Here, the lower roller gear 75*a* has a smaller diameter and the smaller number of teeth thereon than the upper roller gear 71*b*. Therefore, in the case when the driving force of the transporting motor 73 is transmitted to the upper rollers 71 and the lower rollers 72, the lower rollers 72 rotate faster than the upper rollers 71 while slipping.

As described above, in the present embodiment, a lifting mechanism 76 serving as a lifting means is constituted by the transporting motor 73, the motor axis 73*a*, the driving force connecting section 74, the pressing roller 74*a*, the driving gear 74*b*, the upper rollers 71, the roller axis 71*a*, the upper roller gear 71*b*, the clutch 75, the lower roller gear 75*a*, the roller axis 72*a*, and the lower rollers 72. In other words, the ejecting roller section 70 consists of a part of the lifting mechanism 76, or the lifting mechanism 76 is constituted by (a)the ejecting roller section 70 serving as an inputting section where the driving force is inputted for lifting and (b)an outputting section which transmits the driving force for lifting to the ejecting roller section 70.

Additionally, the outputting section is constituted by the transporting motor 73, the motor axis 73*a*, the driving force connecting section 74, the pressing roller 74*a*, the driving gear 74*b*, the roller axis 71*a*, the upper roller gear 71*b*, the clutch 75, the lower roller gear 75*a*, and the roller axis 72*a*.

The following explanation describes operations of ejecting sets of sheets in the sheet postprocessing device 1 which is provided with the lifting mechanism 76.

Figure 8:
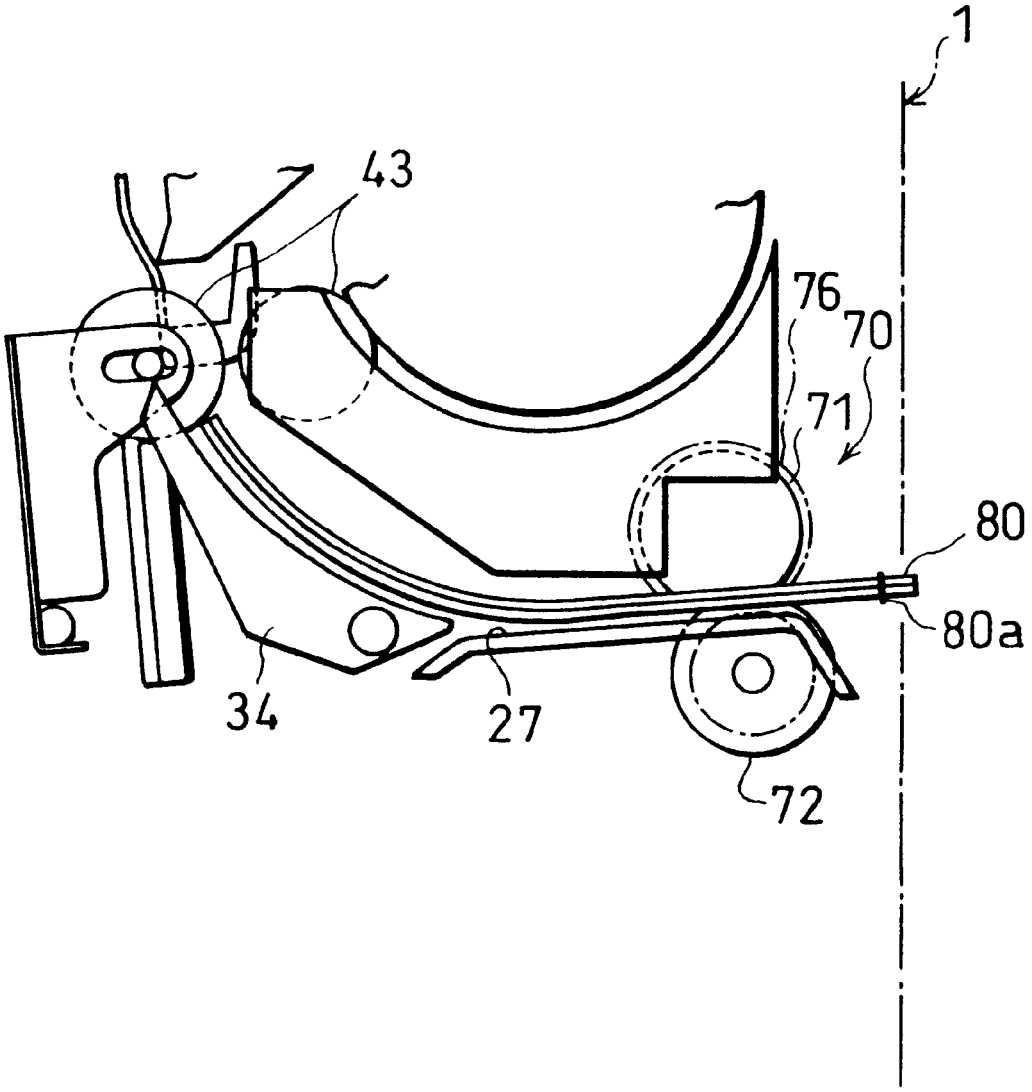
FIG. 8 is an explanatory drawing which shows the set of sheets which passes through paper ejecting rollers of the sheet postprocessing device.
Figure 9:
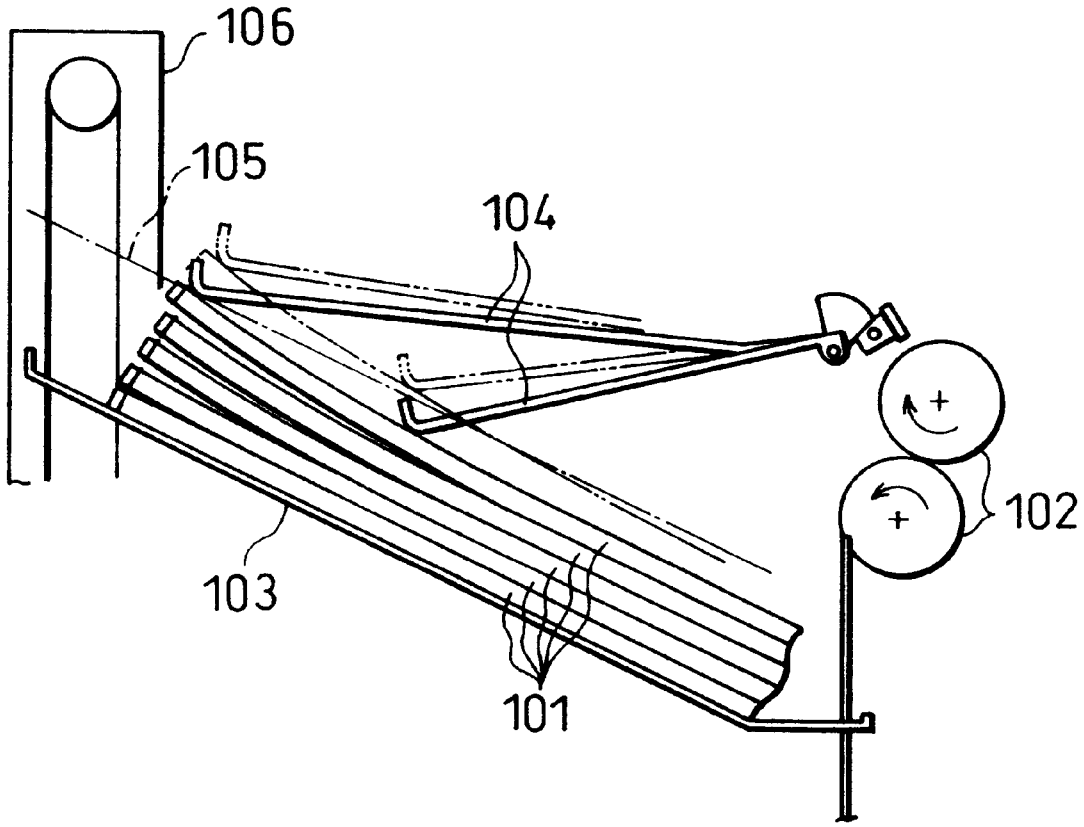
FIG. 9 is a construction drawing which schematically shows a conventional sheet postprocessing device.

Firstly, as illustrated in FIG. 8, a set of sheets 80 stapled on the leading portion thereof is pushed to the offset tray ejection path 27 while being sandwiched between transporting rollers 43, and then passes between the upper rollers 71 and the lower rollers 72 while being sandwiched therebetween.

In this case, with regard to the upper rollers 71 and the lower rollers 72, as shown in FIG. 6, the clutch 75 is separated from the roller axis 72*a*. Therefore, the driving force of the transporting motor 73 is transmitted to the upper rollers 71 via the driving force connecting section 74, the upper roller gear 71*b* and the roller axis 71*a*, and then, the lower rollers 72 are driven by the upper rollers 71.

Therefore, the upper rollers 71 and the lower rollers 72 rotate at the same speed; in addition, both rollers have the same external diameter. Consequently, with regard to the set of sheets 80 which passes between the upper rollers 71 and the lower rollers 72, the upper surface and the bottom surface move at the same speed.

Figure 1:
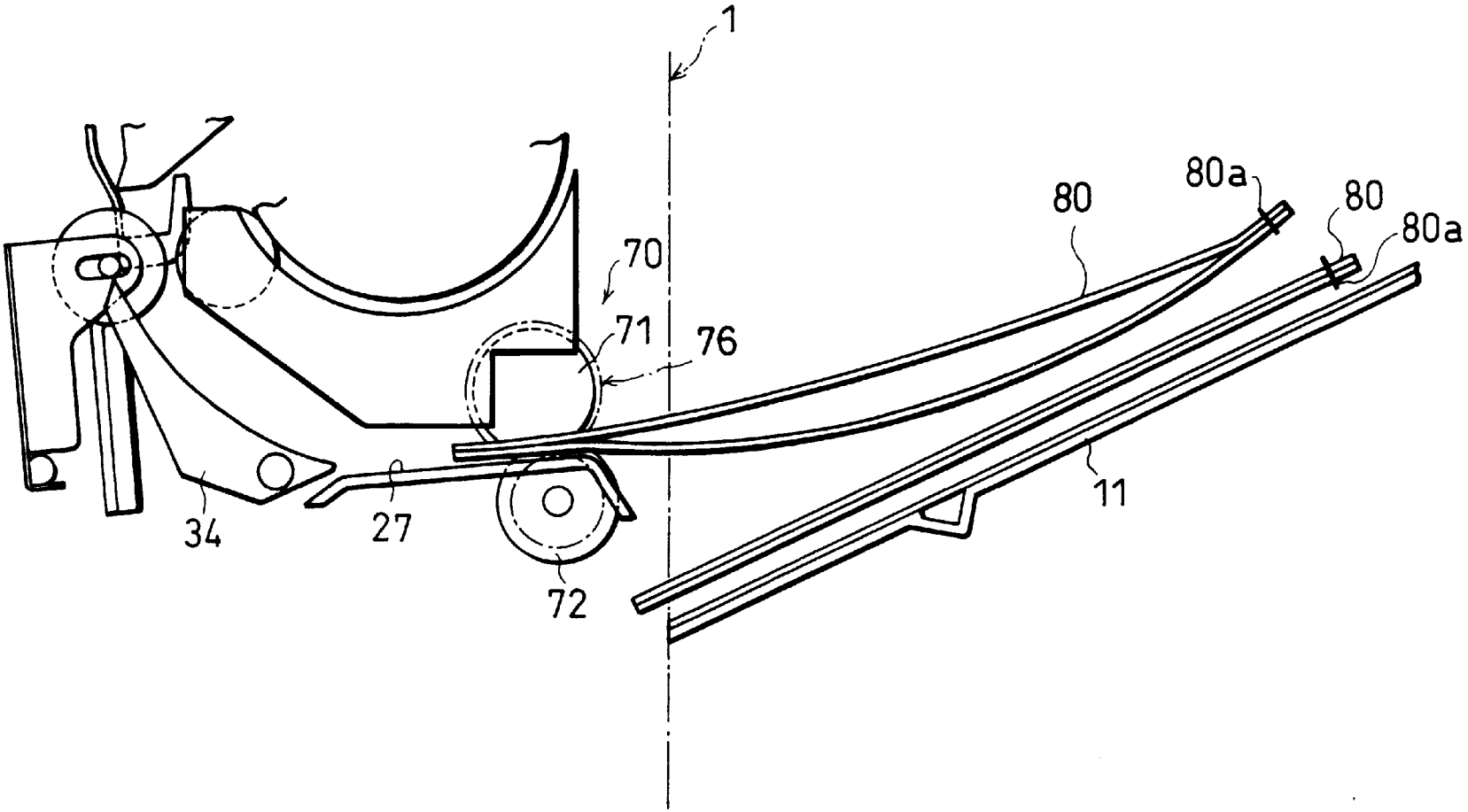
FIG. 1 is an explanatory drawing which shows one embodiment of the present invention and operations of a lifting mechanism of a sheet postprocessing device.

Further, as shown in FIG. 1, when the rear portion of the set of sheets 80 approaches the rollers, the control section (not shown) sends a signal to the clutch 75 so that the clutch 75 connects itself with the roller axis 72*a*. With this operation, as shown in FIG. 6, the rotation driving force of the upper roller gear 71*b* is transmitted to the lower rollers 72 via the lower roller gear 75*a*, the clutch 75, and the roller axis 72*a*. Here, the lower roller gear 75*a* has a smaller diameter and the smaller number of teeth than the upper roller gear 71*b*; therefore, the lower roller gear 75*a* rotates faster than the upper roller gear 71*b*. Consequently, the lower rollers 72 rotate faster than the upper rollers 71.

With this operation, as shown in FIG. 1, with regard to the set of sheets 80, the bottom surface relatively shifts faster than the upper surface. Consequently, as shown in FIG. 1, since the upper surface of the set of sheets 80 is pulled by the upper rollers 71; inevitably, the leading portion of the set of sheets 80 is lifted. In other words, the stapled portion is mainly lifted.

With this operation, the set of sheets 80 is ejected to a position which allows even edges of the stacked sheets, without coming into contact with the sheets which have been ejected and stacked earlier onto the offset tray 11, and then, the rear portion of the set of sheets 80 separates from the ejecting roller section 70 so that the set of sheets is placed on the set of sheets 80 which has been stacked earlier.

With this arrangement, it is possible to stack successively the sets of sheets 80 without disarray, without coming into contact with a staple on the set of sheets 80 which has been ejected and stacked earlier on the offset tray 11 as well as without rubbing the surface of the stacked set of sheets 80.

Furthermore, in the present embodiment, timing and a time period for connecting the clutch 75 are properly adjusted in accordance with the size of the set of sheets 80 and others.

As described above, in the sheet postprocessing device 1, the set of sheets 80 ejected out of the copying machine 2 is normally ejected from the ejecting roller section 70 to the offset tray 11 in a state in which a staple 80*a* exists on the leading portion of the set of sheets 80 with respect to the ejecting direction after having been stacked on the upper staple tray 14 and the lower staple tray 15 and having been subjected to stapling as a postprocessing.

Here, the ejecting roller section 70 is provided with the lifting mechanism 76 for lifting the leading portion of the set of stapled sheets 80 with respect to the ejecting direction. Thus, with regard to a set of sheets 80 to be ejected by the ejecting roller section 70, the lifting mechanism 76 lifts the leading portion of the set of sheets 80, and the set of sheets 80 is shifted and ejected without coming into contact with another set of sheets 80 which has been stacked earlier on the offset tray 11.

Therefore, during the ejecting operation, the leading portion of the set of sheets 80 does not rub the surface of another set of sheets 80 which has been ejected and stacked earlier onto the offset tray 11; thus, it is possible to prevent degradation in the image quality fixed on the surface of the set of sheets 80.

Further, the leading portion of the set of sheets 80 which is being ejected is not caught by the staple 80*a* on another set of sheets 80 which has been ejected and stacked earlier onto the offset tray 11, making it possible to stack sheets without disarray.

Moreover, the lifting mechanism 76 includes the ejecting roller section 70; therefore, even in the case when the offset tray 11 is installed on the outside of the sheet postprocessing device 1, the lifting mechanism 76 is not exposed to the outside.

Thus, it is possible to provide the sheet postprocessing device 1 which positively prevents unevenness of image quality and also prevents edges of the sets of stacked sheets 80 from being uneven during the ejection, without using any means which spoil the appearance of the device, when the sheet postprocessing device 1 ejects the set of sheets 80 to the offset tray 11.

Further, in the sheet postprocessing device 1 of the present embodiment, in order to lift the leading portion with respect to the ejecting direction of the set of sheets 80 which has been stapled on the leading portion with respect to the ejecting direction, the lifting mechanism 76 has a construction in which the ejecting speed of the lower rollers 72 of the ejecting roller section 70 is set relatively greater than the ejecting speed of the upper rollers 71 of the ejecting roller section 70.

Therefore, when the set of sheets 80 passes between the upper rollers 71 and the lower rollers 72 of the ejecting roller section 70, the bottom surface of the set of sheets 80 shifts fast, and the upper surface of the set of sheets 80 shifts at the slower speed than the bottom surface. Consequently, since the leading portion with respect to the ejecting direction of the set of sheets 80 is stapled with the staple 80*a*, the upper surface of the set of sheets 80 is pulled by the upper rollers 71, making it possible to lift the leading portion of the set of sheets 80.

As a result, it becomes possible to provide a practical construction of the lifting mechanism 76 with a simple arrangement. Further, this structure makes it possible to lift the leading portion with respect to the ejecting direction of the set of sheets 80 merely by controlling the rotation of the ejecting roller section 70; therefore, it is not necessary to provide, for example, a member of cantilever type and others on the ejecting side in order to lift the leading portion with respect to the ejecting direction of the set of sheets 80.

Furthermore, in the present embodiment, with regard to the lifting mechanism 76 in which the ejecting speed of the lower rollers 72 of the ejecting roller section 70 is set relatively greater than the ejecting speed of the upper rollers 71 of the ejecting roller section 70, both the upper rollers 71 and the lower rollers 72 are allowed to rotate, and the rotating speed of the lower rollers 72 is set greater than the upper rollers 71. Thus, the difference in speed is provided while both the upper surface and the bottom surface of the set of sheets 80 are shifting in the ejecting direction; therefore; as mentioned below, as compared with the case where the relative difference in speed is provided by stopping the upper rollers 71, the sheets of the set do not slide on each other when the set of sheets 80 is sandwiched between the upper rollers 71 and the lower rollers 72. Thus, it is possible to prevent an image fixed on the sheet from being rubbed, thereby preventing degradation in the image quality.

However, in the present invention, the lifting mechanism 76 is arranged so that the ejecting speed of the lower rollers 72 of the ejecting roller section 70 is set relatively greater than the ejecting speed of the upper rollers 71 of the ejecting roller section 70; therefore, this arrangement also includes a case in which only the upper rollers 71 are stopped while the lower rollers 72 rotate. Therefore, the lifting mechanism 76 may be constructed as a braking means, etc., for merely braking the upper rollers 71, making it possible to further simplify the construction of the lifting mechanism 76.

More specifically, it is possible to arrange the lower rollers 72 as driving rollers and the upper rollers 71 as driven rollers. In addition, for example, a brake shoe (not shown), which serves as a braking means, can be provided on the upper rollers 71 so as to separably contact thereon.

Further, in the sheet postprocessing device 1 of the present embodiment, the lifting mechanism 76 is provided with the clutch 75 for switching between (a)the case in which the ejecting speed of the lower rollers 72 of the ejecting roller section 70 is set relatively greater than the ejecting speed of the upper rollers 71 of the ejecting roller section 70 and (b)the case in which the ejecting speed of the ejecting roller section 70 is set to normal.

Thus, when the sheet is ejected from the ejecting roller section 70 to the offset tray 11 without being stapled, the clutch 75 switches the ejecting speed of the ejecting roller section 70 to normal.

By contrast, when the set of stapled sheets 80 is ejected, the clutch 75 switches the lifting mechanism 76 so that the ejecting speed of the lower rollers 72 of the ejecting roller section 70 is set relatively greater than the ejecting speed of the upper rollers 71 of the ejecting roller section 70.

Moreover, when the set of stapled sheets 80 is ejected, the clutch 75 is capable of adjusting timing and a time period for lifting.

Consequently, it is possible to lift the set of sheets 80 only when lifting is necessary and the lifting level can be adjusted.

Further, the present embodiment exemplifies the case in which the staple operation is carried out on the set of sheets as a postprocessing operation; however, the postprocessing operation is not particularly limited as long as it relates to a binding operation.

For example, specifically, in the case when one end of the set of sheets is bound with paste, and in the case when one end of the set of sheets is bound by applying pressure, the aforementioned arrangement is also applicable.

Furthermore, the present embodiment has a construction in which a plurality of upper rollers serving as ejecting rollers and a plurality of lower rollers serving as ejecting rollers are provided respectively on each roller axis. The number of the rollers installed on each roller axis is not particularly limited as long as the upper roller and the lower roller make a pair so as to eject sheets smoothly.

Moreover, the position of the paired rollers on each roller axis is not particularly limited; however, it is desirable to arrange the paired rollers symmetrically on each roller axis so as to eject sheets smoothly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet postprocessing device, which stacks sheets ejected from an image forming apparatus on a postprocessing tray, and ejects the sheets through an ejecting roller section including ejecting rollers onto an ejection tray after having carried out a postprocessing operation for binding the stacked sheets, comprising:

lifting means for lifting a leading portion of a set of bound sheets, wherein said lifting means comprises said ejecting rollers, said ejecting rollers include an upper roller and a lower roller that lift the leading portion of a set of bound sheets relative to an ejecting direction, and said lower roller has an ejecting speed which is relatively greater than that of said upper roller.

2. The sheet postprocessing device as defined in claim 1, wherein said lifting means comprises a driving force supply for generating a driving force, an inputting section to which the driving force is inputted from said driving force supply, and an outputting section which applies the driving force to said set of bound sheets so as to lift the leading portion, wherein said outputting section is formed by said ejecting rollers.

3. The sheet postprocessing device as defined in claim 1, wherein said lower roller has an ejecting speed which is relatively greater than that of said upper roller.

4. The sheet postprocessing device as defined in claim 3, wherein said lifting means includes switching means for switching between a case in which the ejecting speed of the lower roller acting as an ejecting roller is set greater than that of the upper roller acting as an ejecting roller and a case in which the ejecting speed of the ejecting roller is set to normal.

5. The sheet postprocessing device as defined in claim 1, wherein said lifting means comprises:

a pair of roller gears in which an upper roller gear and a lower roller gear are engaged with each other, said upper roller gear being connected with the upper roller acting as an ejection roller, said lower roller gear being connected with the lower roller acting as an ejecting roller, wherein said upper roller gear has a radius and the number of teeth that are set greater than those of the lower roller gear.

6. The sheet postprocessing device as defined in claim 5, wherein one of said upper roller gear and said lower roller gear is driven by the other.

7. The sheet postprocessing device as defined in claim 6, wherein said lower roller gear is driven by said upper roller gear.

8. The sheet postprocessing device as defined in claim 6, wherein: said switching means includes a clutch which separably engages one of rotating axes of said upper roller gear and said lower roller gear and which controls the transmission of the driving force to the rotating axis.

9. The sheet postprocessing device as defined in claim 1, wherein a plurality of said upper rollers acting as ejecting rollers and a plurality of said lower rollers acting as ejecting rollers are respectively installed on each roller axis so as to be symmetrical.

10. A sheet postprocessing device, which stacks sheets ejected from an image forming apparatus on a postprocessing tray, and ejects the sheets through an ejecting roller section including ejecting rollers onto an ejection tray after having carried out a postprocessing operation for binding the stacked sheets, comprising:

lifting means for lifting a leading portion of a set of bound sheets, wherein said lifting means comprises said ejecting rollers that lift the leading portion of a set of bound sheets with regard to an ejecting direction by curving the set of bound sheets so that a middle portion of the set of bound sheets projects downward, said ejecting rollers including an upper roller and a lower roller, said lower roller having an ejecting speed which is relatively greater than that of said upper roller.

11. The sheet postprocessing device as defined in claim 1, wherein said postprocessing operation is a stapling operation.

12. The sheet postprocessing device as defined in claim 1, further comprising a slanted rail, wherein said slanted rail is set on a guide member which is installed on the image forming apparatus so that said sheet postprocessing device is separably attached to the image forming apparatus.

13. The sheet postprocessing device as defined in claim 1, further comprising a plurality of paths for transporting sheets ejected out of the image forming apparatus so as to switch the paths in accordance with operation modes of the image forming apparatus, memory of the image forming apparatus, sheet size, and kinds of postprocessing operations.

14. The sheet postprocessing device as defined in claim 1, wherein said postprocessing operation is to bind the sheets with paste.

* * * * *

UNITED STATES PATENT AND TRADEMARK OFFICE

CERTIFICATE OF CORRECTION

PATENT NO. : 6,260,837 B1
DATED : July 17, 2001
INVENTOR(S) : Toyoaki Nanba et al.

It is certified that error appears in the above-identified patent and that said Letters Patent is hereby corrected as shown below:

Column 15,
Line 1, change "3" to -- 1 --.

Please delete Claim 3.

Signed and Sealed this

Twenty-third Day of April, 2002

*Attest:*

*Attesting Officer*

JAMES E. ROGAN
*Director of the United States Patent and Trademark Office*